US011684145B2

(12) United States Patent
Chan

(10) Patent No.: US 11,684,145 B2
(45) Date of Patent: Jun. 27, 2023

(54) BUILT-IN TOOTHPASTE TYPE TOOTHBRUSH STRUCTURE

(71) Applicant: YUAN YOANG INDUSTRIAL CO., LTD., Taoyuan (TW)

(72) Inventor: Chien-Tsan Chan, Taoyuan (TW)

(73) Assignee: YUAN YOANG INDUSTRIAL CO., LTD., Taoyuan (TW)

( * ) Notice: Subject to any disclaimer, the term of this patent is extended or adjusted under 35 U.S.C. 154(b) by 78 days.

(21) Appl. No.: 17/464,704

(22) Filed: Sep. 2, 2021

(65) Prior Publication Data

US 2023/0067328 A1 Mar. 2, 2023

(51) Int. Cl.
*A46B 11/00* (2006.01)
*A46B 9/04* (2006.01)
*A46B 5/00* (2006.01)

(52) U.S. Cl.
CPC ..... *A46B 11/0086* (2013.01); *A46B 5/00* (2013.01); *A46B 9/04* (2013.01); *A46B 11/0027* (2013.01); *A46B 11/0037* (2013.01); *A46B 11/0062* (2013.01); *A46B 11/0096* (2013.01); *A46B 2200/1066* (2013.01)

(58) Field of Classification Search
None
See application file for complete search history.

(56) References Cited

U.S. PATENT DOCUMENTS 4,457,641 A * 7/1984 Smith ..... A46B 11/0027 401/173
5,382,106 A * 1/1995 Voigt ..... A46B 11/0024 401/175
5,400,457 A * 3/1995 Ridgley ..... A46B 5/005 401/268
6,056,466 A * 5/2000 Johnson ..... A46B 11/002 401/187
6,129,474 A * 10/2000 Mitchell ..... A46B 11/0027 401/175
6,729,789 B2 * 5/2004 Gordon ..... A46B 11/0017 401/273

(Continued)

FOREIGN PATENT DOCUMENTS

DE 19828557 A1 * 12/1999 ..... A46B 11/0024
TW M575671 3/2019
TW M578959 6/2019

*Primary Examiner* — Brian D Keller
*Assistant Examiner* — Dana Lee Poon
(74) *Attorney, Agent, or Firm* — Fei-hung Yang

(57) ABSTRACT

A built-in toothpaste type toothbrush structure includes toothbrush casing, toothpaste inner tube, knob switch, toothpaste storage handle and pushing structure. The toothbrush casing includes a toothbrush head, an accommodating space, and an outlet and a socketing portion. The toothbrush casing is sheathed on the toothpaste inner tube and has a toothpaste channel inside, and the toothpaste storage handle is connected integrally with the toothpaste inner tube for storing toothpaste, and the pushing structure is installed in the toothpaste storage handle to push the toothpaste to the toothbrush head. Therefore, the knob switch can control the communication between the toothpaste inner tube and the toothbrush casing to avoid contaminating the toothpaste stored in the toothpaste inner tube, so that home and office users or students can carry and use the toothbrush for dental cleaning and oral hygiene conveniently.

5 Claims, 6 Drawing Sheets

(56) References Cited

U.S. PATENT DOCUMENTS

| | | | | |
|---|---|---|---|---|
| 2015/0157122 | A1* | 6/2015 | Prescott | A46B 11/0027 401/175 |
| 2020/0281346 | A1* | 9/2020 | Talbott | A46B 11/0058 |

* cited by examiner

BUILT-IN TOOTHPASTE TYPE TOOTHBRUSH STRUCTURE

BACKGROUND

Technical Field

The present disclosure relates to the technical field of dental cleaning products. More particularly, the present disclosure relates to a built-in toothpaste type toothbrush structure which has the functions of brushing teeth and storing toothpaste, and these two functions are combined into the toothbrush structure to facilitate home/office users or students to clean their teeth after meals or carry the toothbrush conveniently on business trips, and the toothbrush structure comes with a special anti-contamination design capable of avoiding contamination of the toothpaste contained in the toothbrush while using or storing the toothpaste.

Description of Related Art

Good cleaning habits can prevent oral diseases and maintain oral health, and the most common cleaning product is nothing more than a toothbrush. A common toothbrush generally comes with an integral design, and its bristles will be worn out and deformed after for a long time of use and must be replaced to prevent affecting its cleaning effect. At present, various toothbrushes on the market and toothpaste are stored and used separately. However, with the blooming of tourism and related outdoor recreation in recent years, people often carry toothbrushes and toothpaste on business trips or vacations. Regardless of the business trips or vacation, the users still want to travel light to avoid carrying too many items that makes the trip difficult. Even though some hotels will provide disposable toothbrushes and toothpaste, the hardness of the bristles of the toothbrush usually does not meet the user requirements. In recent years, environmental awareness has risen, and many hotels no longer provide the disposable toothbrush and toothpaste, so that the toothbrush and toothpaste have become the must-have items for overnight stays. Taking the convenience of carry and use into consideration, R.O.C. Pat. Nos. M575671 and M578959 entitled "Toothbrush and toothpaste integrated structure" and "Travel toothbrush" respectively have disclosed the integration of the toothbrush and toothpaste for storage and use, but these patents still have various problems as described below. For example, the toothbrush and toothpaste integrated structure disclosed in R.O.C. Pat. No. M575671 adopts a soft toothpaste container as a handle of the toothbrush, and the soft handle is difficult for users to hold while applying force for the use of the toothbrush, and the structure of the toothbrush body is too complicated, so that it is necessary to discard the whole toothbrush after a period of time, which causes unnecessary waste. The travel toothbrush disclosed in R.O.C. Pat. No. M578959 discloses a design having an easy-to-carry and convenient-to-use replaceable brush head, and a toothpaste filler installed in a brush cap that covers the brush head, wherein the toothpaste is squeezed from the filler onto the brush head, and then the brush cap is opened for use. At first glance, there is no problem in this way of use, but the filler is actually located on the brush cap, the filler must be removed temporarily during use, and it must be prepared for the storage of toothpaste, and the pressing component of the filler does not have any protection, and thus the pressing component may be touched or pressed by mistake when not in use. In addition, the filler is covered in the brush cap, it is difficult to know the amount of toothpaste extruded, which also causes trouble in use. Obviously, it is necessary to improve and overcome the shortcomings of the aforementioned patents.

In view of the drawbacks of the prior art, the discloser of this disclosure based on years of experience in the related industry to conduct extensive research and experiment, and finally developed a built-in toothpaste type toothbrush structure that combines the functions of the toothbrush and toothpaste to facilitate their carry and use when going out, and provides the design of a pushing structure capable of squeezing the toothpaste from a toothbrush head directly and controlling the output of toothpaste accurately, and uses a knob switch to drive and turn a toothpaste inner tube to provide a special anti-contamination design, so that the structure of this disclosure has the effects of avoiding the contamination of the toothpaste stored in the structure during use or storage, so as to facilitate its carry and use and improve its practical application.

SUMMARY

Therefore, it is a primary objective of the present disclosure to provide a built-in toothpaste type toothbrush structure having a toothbrush casing, a toothpaste inner tube, a knob switch, a toothpaste storage handle and a pushing structure, and the pushing structure is driven to push a toothpaste along a moving path formed by the toothpaste storage handle and the toothpaste inner tube to a toothbrush head of the toothbrush casing for the use of brushing teeth; and the knob switch is provided for controlling the communication of the toothpaste inner tube with the toothbrush casing to prevent contaminating the stored toothpaste during use or storage, so as to achieve the effects of facilitating the carry and use of the toothbrush and preventing leakage or contamination of the toothpaste when not in use.

To achieve the foregoing and other objectives, the present disclosure discloses a built-in toothpaste type toothbrush structure, including: a toothbrush head installed to an end thereof, an accommodating space defined in the toothbrush casing, and an outlet and a socketing portion formed at both ends of the accommodating space respectively, and the outlet being configured to be corresponsive to the toothbrush head;

a toothpaste inner tube, being in a shape of a straight tubular structure corresponding to the accommodating space for letting the toothbrush casing sheath on the toothpaste inner tube, and the toothpaste inner tube having a toothpaste channel therein, and an end of the toothpaste channel having a toothpaste hole configured to be corresponsive to the outlet, and the other end of the toothpaste channel is formed with a connection portion; a knob switch, sheathed on the toothpaste inner tube to form a communication control, and provided for driving the toothpaste inner tube to rotate by turning the knob switch, in order to control the communication status between the toothpaste hole and the outlet; a toothpaste storage handle, having a relative connection portion disposed at a top end thereof and configured to be corresponsive to the connection portion, and provided for integrally coupling the toothpaste storage handle with the toothpaste inner tube, such that the toothpaste channel is communicated with the toothpaste storage handle, and the toothpaste storage handle having a toothpaste storage space defined therein for storing a toothpaste; and a pushing structure, installed in the toothpaste storage handle and disposed on a side of the toothpaste storage space, and the pushing structure having an actuating portion, which is operated to deliver the toothpaste from the toothpaste storage space into the toothpaste channel, so that the toothpaste can reach the toothbrush head for use.

In an embodiment of this disclosure, the built-in toothpaste type toothbrush structure further includes a viewing window disposed at a position of the toothpaste storage handle and configured to be corresponsive to the toothpaste storage space.

In another an embodiment of this disclosure, the pushing structure has a piston disposed at the front end thereof and configured to be corresponsive to the toothpaste storage space, and coupled to the actuating portion, so that the actuating portion can be operated to drive the pushing structure to link to the piston and generate a pushing force required for delivering the toothpaste. In addition, the pushing structure is a multi-sectional telescopic tube module having a telescopic end disposed on a side of the piston and a fixed end linked with the actuating portion, and after the actuating portion is operated to rotate, the multi-sectional telescopic tube module stretches to link with the piston. The multi-sectional telescopic tube module is formed by sequentially screwing a central shaft, a first tubular socket, a second tubular socket and a third tubular socket, and the central shaft has a first threaded portion disposed on an outer surface thereof, and the first tubular socket has a second threaded portion disposed on an outer surface thereof and a third threaded portion disposed on an inner surface thereof, and the second tubular socket has a fourth threaded portion disposed on an outer surface thereof and a fifth threaded portion disposed on an inner surface thereof, and the third tubular socket has a sixth threaded portion disposed on an inner surface thereof, and the first tubular socket has a first limit portion disposed relative to the central shaft, such that the central shaft can be rotated all the way to its end to define a limit position, and the second tubular socket has a second limit portion disposed relative to the first tubular socket, such that the first tubular socket can be rotated all the way to its end to define a limit position, and the third tubular socket has a third limit portion disposed relative to the second tubular socket, such that the second tubular socket can be rotated all the way to its end to define a limit position. Therefore, the central shaft, the first tubular socket and the second tubular socket can be stretched and pushed out sequentially to drive the piston to squeeze out the toothpaste. After the toothpaste stored in the toothpaste storage handle is squeezed out completely, the central shaft can be rotated in an opposite direction until the multi-sectional telescopic tube module returns to its original position, so that users can refill the toothpaste into the toothpaste storage space.

In another embodiment of this disclosure, the pushing structure is a telescopic tube, and the toothpaste storage space is formed in the telescopic tube, and the telescopic tube has an end with an extrusion port coupled to the toothpaste inner tube and the other end linked with the actuating portion, and the actuating portion can be operated and pushed to squeeze the telescopic tube to output the toothpaste.

DESCRIPTION OF THE EMBODIMENTS

This disclosure will now be described in more detail hereinafter with reference to the accompanying drawings that show various embodiments of the invention.

Figure 1:
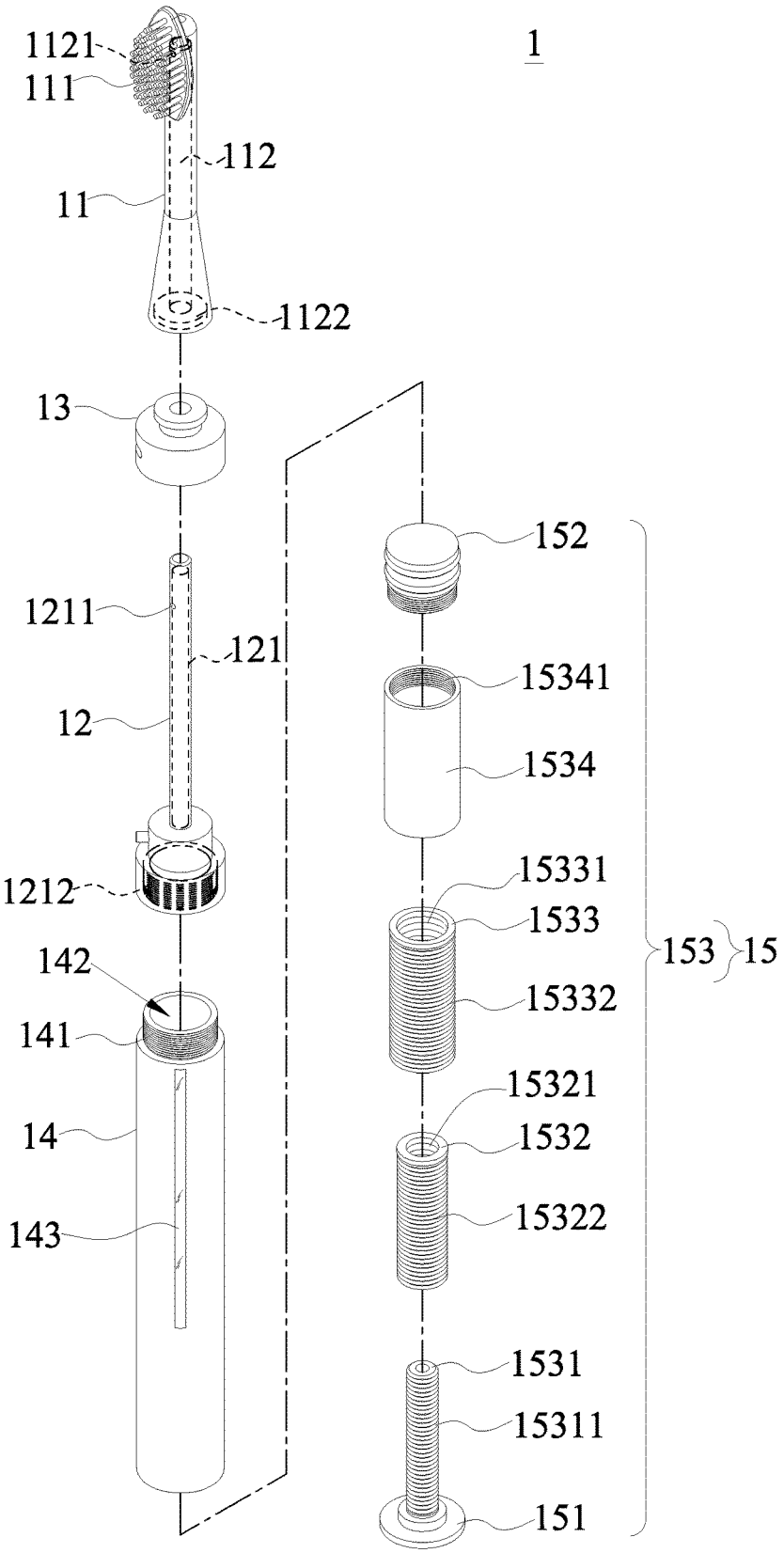
FIG. 1 is an exploded view of a first preferred embodiment of this disclosure.
Figure 2:
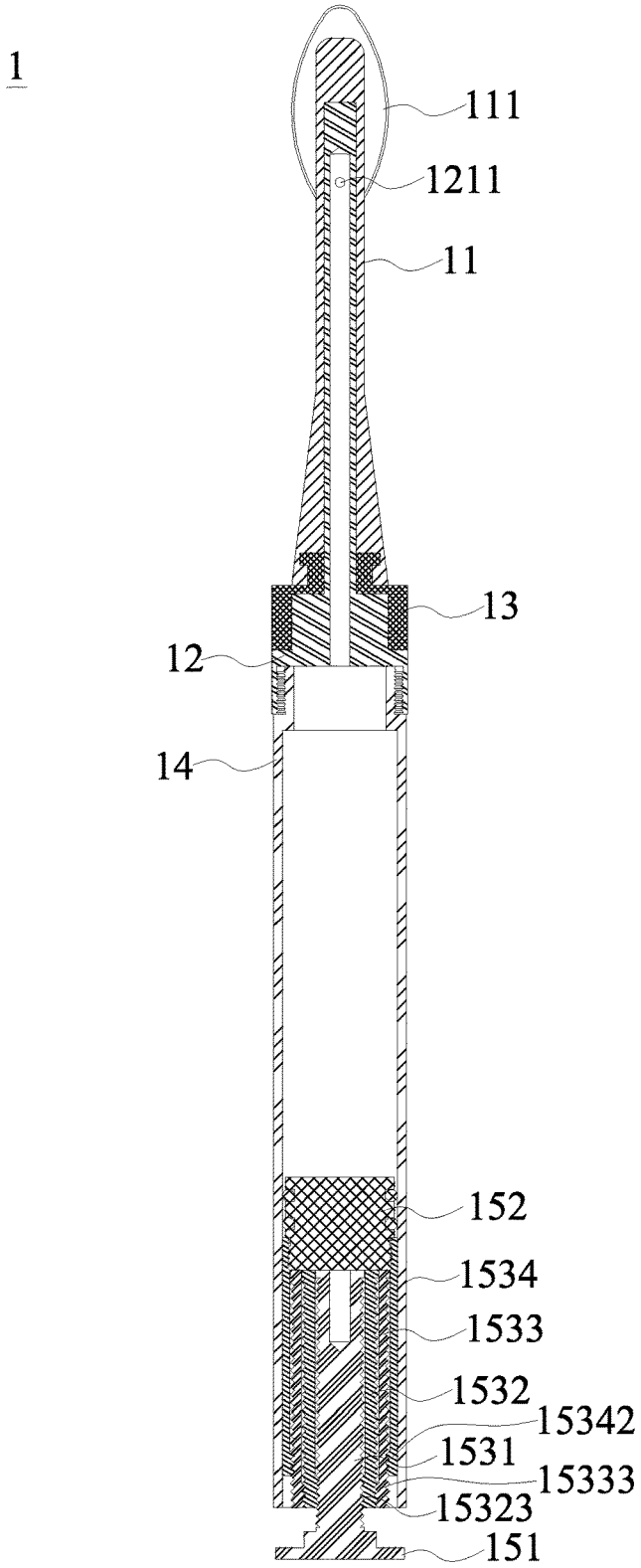
FIG. 2 is a cross-sectional view of the assembly of the first preferred embodiment of this disclosure.
Figure 3:
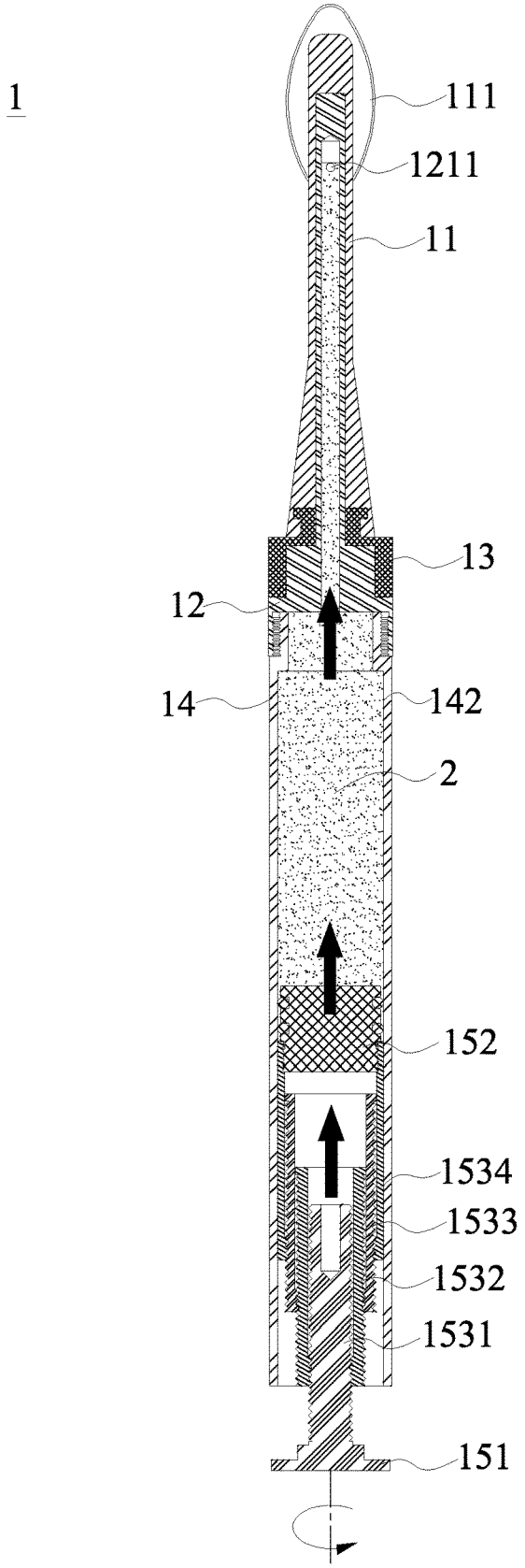
FIG. 3 is a schematic view showing an operating status of the first preferred embodiment of this disclosure.

With reference to FIGS. 1, 2 and 3 for the exploded view, the cross-sectional view and operating status of a built-in toothpaste type toothbrush structure in accordance with the first preferred embodiment of this disclosure respectively, the built-in toothpaste type toothbrush structure 1 includes a toothbrush casing 11, a toothpaste inner tube 12, a knob switch 13, a toothpaste storage handle 14 and a pushing structure 15.

The toothbrush casing 11 has a toothbrush head 111 disposed at an end thereof, and the toothbrush casing 11 has an accommodating space 112 formed therein, and an outlet 1121 and a socketing portion 1122 are formed at both ends of the accommodating space 112 respectively, and the outlet 1121 is configured to be corresponsive to the toothbrush head 111.

The toothpaste inner tube 12 is in a shape of a straight tubular structure corresponding to the accommodating space 112 for letting the toothbrush casing 11 sheath on the toothpaste inner tube 12, and the toothpaste inner tube 12 has a toothpaste channel 121 formed in the toothpaste inner tube 12, and the toothpaste channel 121 has a toothpaste hole 1211 formed at an end of the toothpaste channel 121 and configured to be corresponsive to the outlet 1121 and a connection portion 1212 formed at the other end of the toothpaste channel 121.

The knob switch 13 is sheathed on the toothpaste inner tube 12 and configured to be corresponsive to the connection portion 1212, and the knob switch 13 is communicated with the toothpaste inner tube 12 for a control, wherein the knob switch 13 can be turned to control the communication status between the toothpaste hole 1211 and the outlet 1121.

The toothpaste storage handle 14 has a relative connection portion 141 disposed at the top end thereof and configured to be corresponsive to the connection portion 1122 for connecting the toothpaste storage handle 14 and the toothpaste inner tube 12 integrally, and the toothpaste channel 121 is communicated with the toothpaste storage handle 14, and the toothpaste storage handle 14 has a toothpaste storage space 142 formed therein for storing a toothpaste 2. It is noteworthy that the toothpaste storage handle 14 of this disclosure has a viewing window 143 configured to be corresponsive to the toothpaste storage space 142 and provided for observing the storage status of the toothpaste 2.

The pushing structure 15 is installed in the toothpaste storage handle 14 and disposed on a side of the toothpaste storage space 142, and the pushing structure 15 has an actuating portion 151 which can be operated to deliver the toothpaste 2 from the toothpaste storage space 142 into the toothpaste channel 121, so that the toothpaste 2 can reach the toothbrush head 11 for its use. With reference to FIGS. 1 and 2 for the first preferred embodiment of this disclosure, the pushing structure 15 has a piston 152 disposed at a front end thereof and configured to be corresponsive to the toothpaste storage space 142, and the pushing structure 15 and the actuating portion 151 are connected to each other, so that when the actuating portion 151 is operated to drive the pushing structure 15 to link with the piston 152, so as to generate a pushing force required for delivering the toothpaste 2. In addition, the pushing structure 15 is a multi-sectional telescopic tube module 153 having a telescopic end disposed on a side of the piston 152 and a fixed end linked with the actuating portion 151, and the actuating portion 151 is a knob that can be operated and turned to stretch the multi-sectional telescopic tube module 153 to link with the piston 152. In FIG. 1, the multi-sectional telescopic tube module 153 of this disclosure is formed by sequentially screwing a central shaft 1531, a first tubular socket 1532, a second tubular socket 1533 and a third tubular socket 1534, wherein the outer surface of the central shaft 1531 has a first threaded portion 15311; the outer surface of the first tubular socket 1532 has a second threaded portion 15321 and the inner surface of the first tubular socket 1532 has a third threaded portion 15322; the outer surface of the second tubular socket 1533 has a fourth threaded portion 15331 and the inner surface of the second tubular socket 1533 has a fifth threaded portion 15332; and the inner surface of the third tubular socket 1534 has a sixth threaded portion 15341. In addition, the first tubular socket 1532 has a first limit portion 15323 relative to the central shaft 1531, and the central shaft 1531 can be turned all the way to its end to define a limit position; the second tubular socket 1533 has a second limit portion 15333 relative to the first tubular socket 1532, and the first tubular socket 1532 can be turned all the way to its end to define a limit position; and the third tubular socket 1534 has a third limit portion 15342 relative to the second tubular socket 1533, and the second tubular socket 1533 can be turned all the way to its end to define a limit position.

Figure 4:
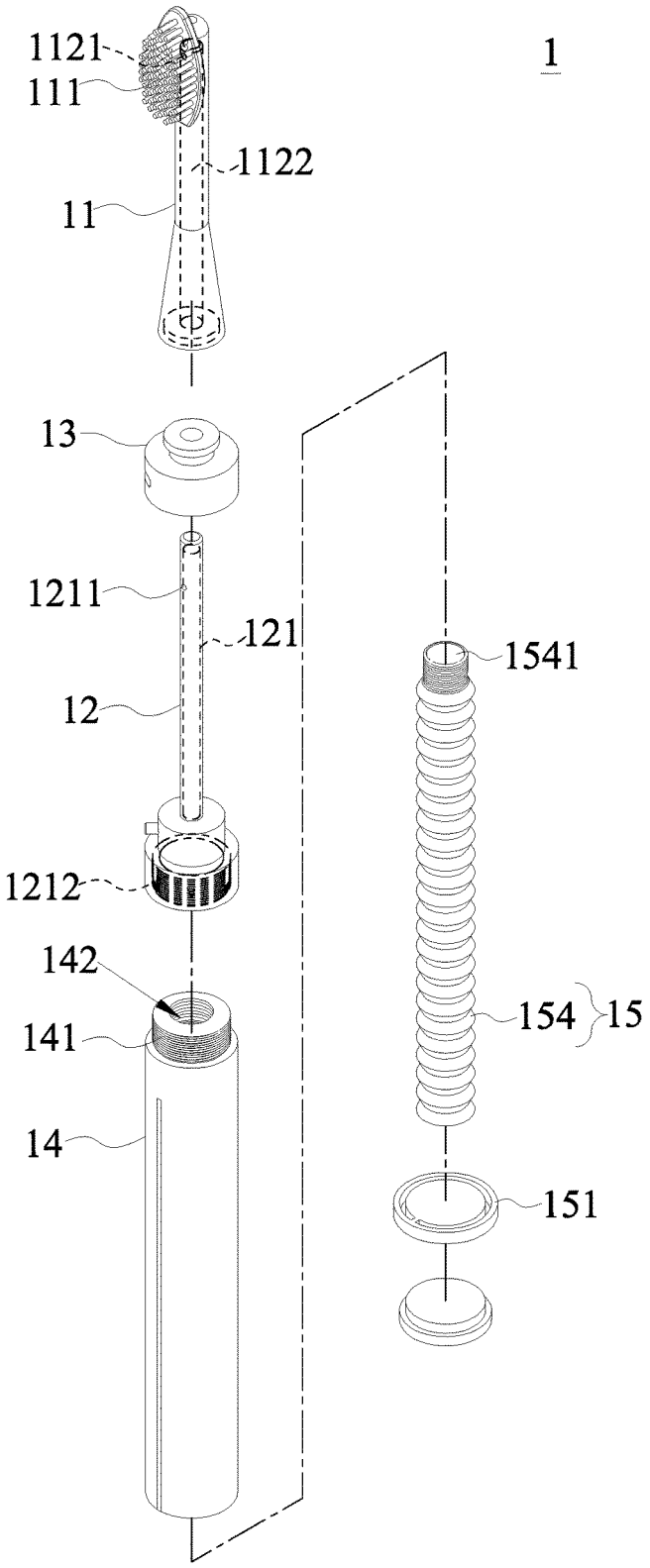
FIG. 4 is an exploded view of a second preferred embodiment of this disclosure.
Figure 5:
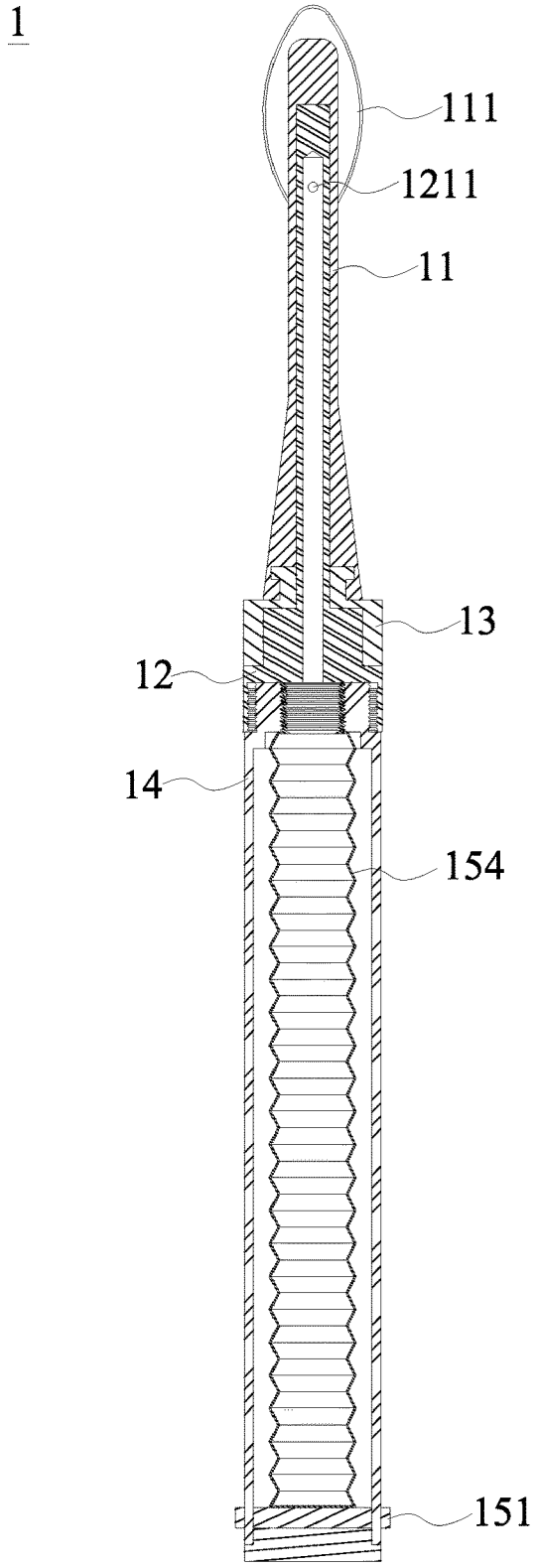
FIG. 5 is a cross-sectional view of the assembly of the second preferred embodiment of this disclosure.
Figure 6:
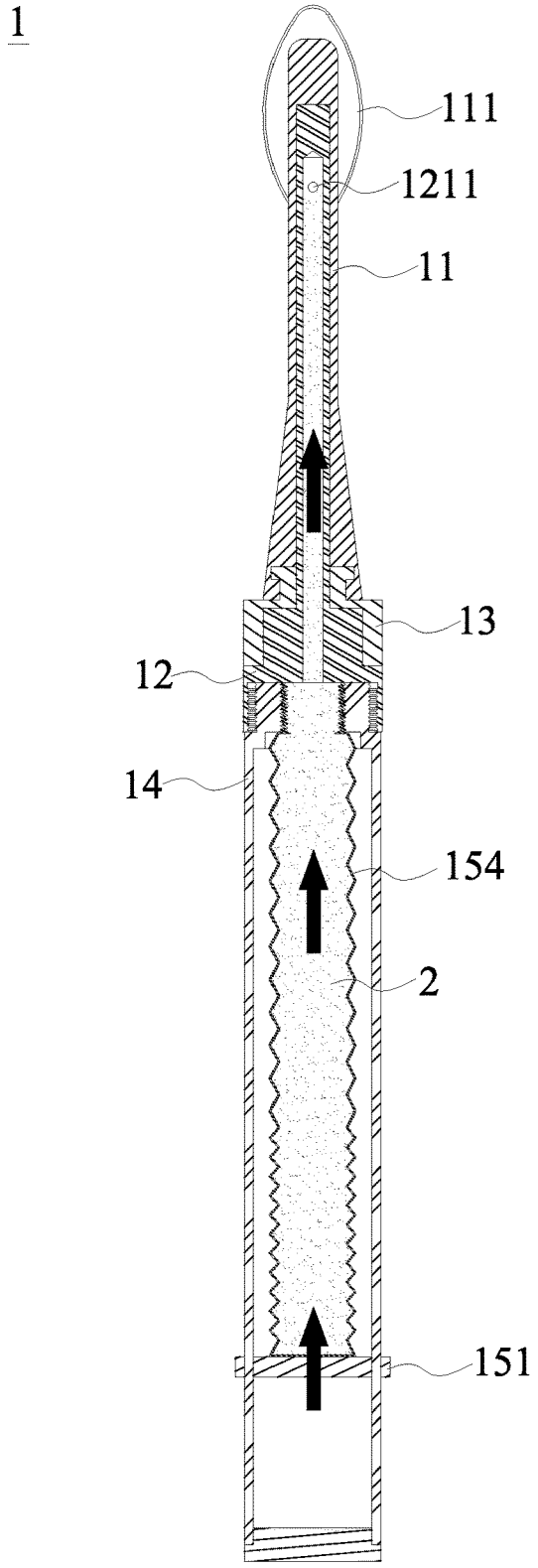
FIG. 6 a schematic view showing an operating status of the second preferred embodiment of this disclosure.

With reference to FIGS. 4, 5 and 6 for the exploded view, the cross-sectional view and operating status of a built-in toothpaste type toothbrush structure in accordance with the second preferred embodiment of this disclosure respectively, 係為 second preferred embodiment of this disclosure, most parts of the structure of the built-in toothpaste type toothbrush structure of this embodiment are the same as those of the previous embodiment, so that their components and assembly will not be repeated. However, in the second preferred embodiment, the pushing structure 15 is a telescopic tube 154 having the toothpaste storage space 142 formed in the telescopic tube 154 for storing the toothpaste 2, and the telescopic tube 154 has an extrusion port 1541 disposed at an end thereof and connected to the toothpaste inner tube 12 and the other end linked with the actuating portion 151, and the actuating portion 151 is a push ring sheathed on the toothpaste storage handle 14, and the actuating portion 151 can be operated to push and squeeze the telescopic tube 154 to output the toothpaste 2 from the extrusion port 1541.

The built-in toothpaste type toothbrush structure 1 of this disclosure drives the pushing structure 15 by a rotating or pushing method to push the toothpaste 2 along the moving path formed by the toothpaste storage handle and the toothpaste inner tube 12 to the toothbrush head of the toothbrush casing for the use of brushing teeth; and the knob switch 13 is provided for controlling the communication of the toothpaste inner tube 12 with the toothbrush casing 11 to prevent contaminating the stored toothpaste 2 during use or storage, so as to achieve the effects of facilitating the carry and use of the toothbrush and preventing leakage or contamination of the toothpaste when not in use. This structure can be used as a switch for storage to prevent the toothpaste 2 from leaking out accidentally, so that the structure of this disclosure can provide the easy-to-carry and convenient-to-use effects when the users are going out.

What is claimed is:

1. A built-in toothpaste type toothbrush structure, comprising:

a toothbrush casing, having a toothbrush head installed to an end thereof, an accommodating space defined in the toothbrush casing, and an outlet and a socketing portion formed at both ends of the accommodating space respectively, and the outlet being configured to be corresponsive to the toothbrush head;

a toothpaste inner tube, being in a shape of a straight tubular structure corresponding to the accommodating space for letting the toothbrush casing sheath on the toothpaste inner tube, and the toothpaste inner tube having a toothpaste channel therein, and an end of the toothpaste channel having a toothpaste hole configured to be corresponsive to the outlet, and the other end of the toothpaste channel is formed with a connection portion;

a knob switch, sheathed on the toothpaste inner tube to form a communication control, and provided for driving the toothpaste inner tube to rotate by turning the knob switch, in order to control communication status between the toothpaste hole and the outlet;

a toothpaste storage handle, having a relative connection portion disposed at a top end thereof and configured to be corresponsive to the connection portion, and provided for integrally coupling the toothpaste storage handle with the toothpaste inner tube, such that the toothpaste channel is communicated with the toothpaste storage handle, and the toothpaste storage handle having a toothpaste storage space defined therein for storing a toothpaste; and a pushing structure, installed in the toothpaste storage handle and disposed on a side of the toothpaste storage space, and the pushing structure having an actuating portion, which is operated to deliver the toothpaste from the toothpaste storage space into the toothpaste channel, so that the toothpaste can reach the toothbrush head for use;

wherein the pushing structure has a piston disposed at the front end thereof and configured to be corresponsive to the toothpaste storage space, and the pushing structure is coupled to the actuating portion, so that the actuating portion can be operated to drive the pushing structure to link to the piston and generate a pushing force required for delivering the toothpaste;

wherein the pushing structure is a multi-sectional telescopic tube module having a telescopic end disposed on a side of the piston and a fixed end linked with the actuating portion, and after the actuating portion is operated to rotate, the multi-sectional telescopic tube module stretches to link with the piston;

wherein the multi-sectional telescopic tube module is formed by sequentially screwing a central shaft, a first tubular socket, a second tubular socket and a third tubular socket, and the central shaft has a first threaded portion disposed on an outer surface thereof, and the first tubular socket has a second threaded portion disposed on an outer surface thereof and a third threaded portion disposed on an inner surface thereof, and the second tubular socket has a fourth threaded portion disposed on an outer surface thereof and a fifth threaded portion disposed on an inner surface thereof, and the third tubular socket has a sixth threaded portion disposed on an inner surface thereof, and the first tubular socket has a first limit portion disposed relative to the central shaft, such that the central shaft can be rotated all the way to an end of the first limit portion to define a limit position, and the second tubular socket has a second limit portion disposed relative to the first tubular socket, such that the first tubular socket can be rotated all the way to an end of the second limit portion to define a limit position, and the third tubular socket has a third limit portion disposed relative to the second tubular socket, such that the second tubular socket can be rotated all the way to an end of the third limit portion to define a limit position.

2. The built-in toothpaste type toothbrush structure according to claim 1, further comprising a viewing window disposed at a position of the toothpaste storage handle and configured to be corresponsive to the toothpaste storage space.

3. The built-in toothpaste type toothbrush structure according to claim 1, wherein the actuating portion is a push ring.

4. The built-in toothpaste type toothbrush structure according to claim 1, wherein the pushing structure is a telescopic tube, and the toothpaste storage space is formed in the telescopic tube, and the telescopic tube has an end with an extrusion port coupled to the toothpaste inner tube and the other end linked with the actuating portion, and the actuating portion can be operated and pushed to squeeze the telescopic tube to output the toothpaste.

5. The built-in toothpaste type toothbrush structure according to claim 4, wherein the actuating portion is a push ring sheathed on the toothpaste storage handle.

* * * * *